US008124875B2

(12) United States Patent
Aitken et al.

(10) Patent No.: US 8,124,875 B2
(45) Date of Patent: Feb. 28, 2012

(54) ALUMINUM GROUNDING CABLE FOR METAL AND NON METAL SHEATHED ELECTRICAL CABLES

(75) Inventors: Hal Aitken, Rockwood (CA); Mark Hartley, Toronto (CA); Doug Drysdale, Orangeville (CA); Hal Armstrong, Fergus (CA); Sidney Wierstra, Grand Valley (CA); Dave Hawker, Otisville (CA)

(73) Assignee: Nexans, Paris (FR)

( * ) Notice: Subject to any disclaimer, the term of this patent is extended or adjusted under 35 U.S.C. 154(b) by 277 days.

(21) Appl. No.: 12/360,311

(22) Filed: Jan. 27, 2009

(65) Prior Publication Data

US 2010/0186987 A1 Jul. 29, 2010

(51) Int. Cl.
*H01B 7/00* (2006.01)

(52) U.S. Cl. ..... 174/102 R; 174/109; 174/102 SC

(58) Field of Classification Search ..... 174/36, 174/27, 102 R, 102 D, 105, 106 R, 110 R, 174/113 R, 116
See application file for complete search history.

(56) References Cited

U.S. PATENT DOCUMENTS

| | | | | |
|---|---|---|---|---|
| 4,374,299 | A * | 2/1983 | Kincaid | 174/36 |
| 5,329,065 | A * | 7/1994 | Marney et al. | 174/128.1 |
| 5,841,072 | A | 11/1998 | Gagnon | |
| 6,259,019 | B1 * | 7/2001 | Damilo et al. | 174/36 |
| 6,486,395 | B1 * | 11/2002 | Temblador | 174/36 |
| 7,166,802 | B2 * | 1/2007 | Cusson et al. | 174/113 R |
| 7,469,470 | B2 * | 12/2008 | Cusson et al. | 29/825 |
| 7,880,089 | B1 * | 2/2011 | Herrin | 174/113 R |

* cited by examiner

*Primary Examiner* — William Mayo, III
(74) *Attorney, Agent, or Firm* — Sofer & Haroun, LLP

(57) ABSTRACT

An electrical power cable includes a conductor core having at least two insulated phase conductors twisted together and a binder tape configured to cover the twisted conductor core. A bare aluminum grounding conductor is laid longitudinally outside the binder tape, along the length of the conductor core and a metal armor is disposed around the grounding conductor and conductor core defining a metal armor for the electrical power cable.

29 Claims, 11 Drawing Sheets

ALUMINUM GROUNDING CABLE FOR METAL AND NON METAL SHEATHED ELECTRICAL CABLES

BACKGROUND

1. Field of the Invention

The present invention relates to cable assemblies having an aluminum grounding conductor.

2. Description of Related Art

Metal clad (MC) and armored cables (AC), are a flexible metal conduit with a wire bundle, consisting of individually insulated conductors covered by a flexible spiral-wound interlocking layer of metal tape. Most often used for feeder and service power in commercial and multi-story residential applications, the steel or aluminum clad cables are more resistant to damage from puncture or abrasion than non-metallic sheathed cable.

Various standards across the world govern the specifications for metal clad (MC) and armored cables (AC). These standards include those specified by Underwriter Laboratories under UL1569 for metal clad (MC) cables, UL 4 for AC cables and CSA C22.2 No.51 for AC90 cables. Other standards include those promulgated by National Engineering Code (NEC) sections 330 governing MC cables and 250 governing grounding arrangements. For Non Metallic cables the codes set forth in NEC 334 apply as well. Additionally, when these types of cables are used in Healthcare facilities, other sections of NEC, such as NEC Article 517 provide further characteristic requirements for proper grounding when equipment interfaces with human patients and operators.

Furthermore, AC cables having a 90 degree insulation rating (AC90) are specified by Canadian Standards Association under CSA C22.2 No 51, the installation is covered by the Canadian Electrical Code (CEC) part 1 section 12-600 for installation and 10-600 for bonding methods. Rule 10-618 of the CEC covers termination.

Typically, MC cables that are constructed in accordance with the specification set forth by UL 1569 include a cabled core of at least two conductors along with an insulated copper bonding conductor cabled with the conductors. A printed plastic tape binder covers the conductors and bonding conductor assembly, with the resultant assembly encased within an aluminum interlock armor. The grounding copper conductor, which at the cable termination provides the grounding capacity required under the specified standards. In reality there are two paths for MC cables for grounding, through the armor strip and through the designated insulated grounding conductor.

Typically, AC cables contain a conductor assembly that includes at least three insulated conductors. One of the conductors is designated as a grounding conductor. Each insulated conductor is individually wrapped with a paper covering. A plastic legend tape is added and printed to identify the cable and manufacturer as specified in UL 4. The conductors are twisted together or cabled into a bundle in accordance with the lay requirements set forth in UL 4. A bonding strip is laid lengthwise along the core conductors while the entire assembly is subjected to an armoring process. The bonding strip may be made of a strip of a thin bare aluminum bonding wire disposed in direct contact with the metal-tape armor. There are three paths for AC cables for grounding, through the armor strip, through the bonding strip, and through the designated insulated grounding conductor.

AC90 cables are manufactured for the Canadian market (Armored Cable with 90 degree C. insulation) per CSA C22.2 No. 51 for Armoured Cables (Canadian Standard Association). Typically, MC or AC cables described above and made to UL 1569, and UL 4 do not meet the requirements of CSA C22.2 No. 51. AC90 cables are typically two, three or four copper or compact ACM aluminum conductors with low temperature cross-linked polyethylene insulation (R90 XLPE) to meet −40° C. Cold Bend and Cold Impact test requirements, PVC/Nylon insulation is sometimes used, but only meets −25° C. Cold Bend and Cold Impact test requirements. A bare copper or aluminum bonding wire is cabled in the assembly, and the assembly is paper wrapped and covered with a bare interlocking aluminum armor. In the circuit sizes 14 to 10 AWG, the conductors are typically solid, and for sizes 8 AWG and larger, the conductors are typically stranded.

NMD (Non Metallic sheathed) cables are constructed to CSA C22.2 No. 48 in Canada and called NMD90 (90° C. insulation) and UL 719 and called NMB in the USA. NMD90 typically is made in a 2 or 3 conductor arrangement. For the 2 conductor construction, the color coded insulated conductor is placed longitudinally and the bare grounding conductor is placed in the center and covered by a sheath, as shown in a figure 8 profile. Cable identification is printed on the cable. Sheaths are colored to help the installer distinguish the different conductor sizes. In the 3 conductor construction, the conductors with a bare grounding conductor are cabled and covered by a sheath. For the 10 AWG to 14 AWG circuit sizes, the conductors are typically solid, for sizes 8 AWG and larger, the conductors are stranded. Different insulation systems can be applied to meet the 90° C. temperature rating. For the NMB, manufactured to UL 719—Nonmelallic Sheathed Cables, in the 2 conductor construction, the bare grounding conductor is covered by a paper wrap, and the over-all assembly is given a paper wrap, and then sheathed. In the 3 conductor construction, only the bare grounding conductor is covered by a paper wrap and one has the option to cable the conductors in a parallel or twisted configuration. Insulation and sheath thicknesses are specified in the appropriate Standards. 8 AWG and larger conductors are typically stranded.

Recently, in view of the rising cost of copper, cable manufacturers have introduced a substitute design, wherein the MC cable contains a bare aluminum grounding conductor, which is cabled in concert with the conductor assembly in an arrangement where the conductors are encased within an insulating tape such as a polypropylene printed legend tape binder and the bare aluminum grounding conductor is cabled outside of the tape binder. For MC cables the grounding path of this cable now has combined the armor ground path and the bare ground path as one. Although this design has reduced the cost of manufacturing MC cables, there is still a need for alternative solutions and for providing a value better than that provided by products manufactured today.

SUMMARY

In accordance with various embodiments of the invention, a metal-clad cable is provided that has a reliable grounding conductor made of aluminum.

Specifically, and in accordance with one embodiment of the present invention, a metal clad cable is provided having a bare aluminum, copper clad aluminum or copper grounding conductor wire that is laid in longitudinally along the entire length of the cable. The cable includes a core with insulated phase conductors that are twisted together or laid longitudinally without cabling. A binder, such as a polypropylene tape, encloses the conductor core, leaving the grounding conductor wire disposed externally to the tape.

In accordance with another embodiment of the present invention, a metal clad cable is provided having a bare aluminum grounding conductor that is laid and cabled with a conductor assembly. The conductor assembly includes at least a twisted pair of insulated conductors cabled with the bare grounding conductor.

In accordance with another embodiment of the invention, a metal clad cable is provided having a bare aluminum grounding conductor wire that is paper wrapped. The paper wrapped conductor is cabled with the twisted core conductors and the entire assembly is enclosed in a binder tape.

In accordance with still another embodiment of the invention, a metal clad cable is provided that includes a bare aluminum bonding strip having a non-circular cross section, that is laid longitudinally external to a tape enclosing twisted conductor assembly.

In accordance with still another embodiment of the invention, a metal clad cable is provided that includes a grounding conductor composed of multiple bare aluminum bonding wires or strips that are laid longitudinally external to a tape enclosing twisted conductor assembly.

In accordance with still another embodiment of the invention, the bare aluminum grounding conductor described above is employed in a non-metallic sheathed cable.

DETAILED DESCRIPTION OF VARIOUS EMBODIMENTS OF THE INVENTION

Figure 1:
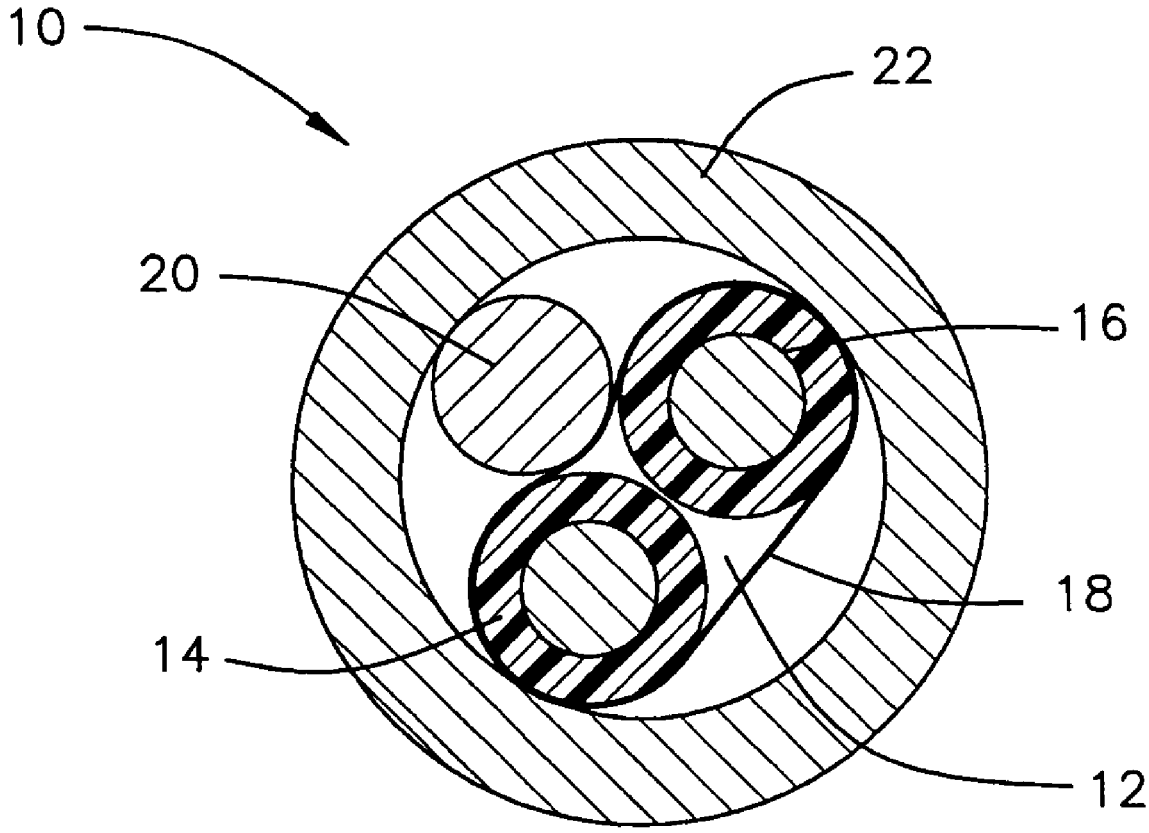
FIG. 1 illustrates a cable having a bare grounding conductor placed longitudinally over a tape binder and in contact with the armor and made in compliance with UL 1569 and UL 4 in accordance with one embodiment of the invention.

FIG. 1 illustrates one embodiment of a metal clad cable 10 in accordance with one embodiment of the invention. A conductor assembly 12 forms a core having insulated phase conductors, such as 14 and 16 that are twisted or cabled together. The conductor types most often used are copper and aluminum alloys such as 8000 series or 1350 series, although the invention is not limited in scope in this respect.

It is noted that the various embodiments of the present invention as described herein include all types of metals and combinations of metals, such as mixed metals like copper clad aluminum, or super conducting metals, etc. Conductors in 14, 12 and 10 AWG are more common, and in accordance with various embodiments of the present invention, are constructed as a single solid conductor or provided as a stranded construction, typically with 7 or 19 individual strands. The conductors are constructed as specified in ASTM standards, found in Volume 2.03. As such, the present scope does not exclude other conductor constructions.

Furthermore, the insulation material employed in accordance with various embodiments of the present invention includes, but is not limited to, those used for metal clad cable products such as PVC/Nylon insulation. Common Types are called THHN or THWN-2. In this disclosure, all insulation types that are mentioned in UL 1569 (Section 7.2) are included. Furthermore, other types of insulation, such as halogen free insulation types like polyolefins etc., are also contemplated within the scope of the present disclosure and accompanying claims.

As illustrated in FIG. 1, conductors 14 and 16 are covered by a tape binder 18, such as one made of polypropylene. Different materials for the binder tape can be used. Typically polypropylene or polyester materials are most commonly used in the industry. It is noted, however, that the invention is not limited in scope in that respect and other binder types such as flame retardant papers, multiple binders having different widths as well as different methods of application of the binder are contemplated within the scope of the accompanying claims.

In one embodiment of the invention, the binder has a printed legend for identification. Legends are marked with all the markings in compliance With various standards' requirements such as UL 1569 or UL 4.

A bare aluminum grounding conductor 20 is laid longitudinally outside tape binder 18. The entire assembly including the conductors 14, 16 and grounding conductor 20 are covered by an aluminum interlocking armor cable 22, such that the bare grounding conductor 20 is in contact with a substantial portion of the armor. The aluminum bare grounding conductor when placed longitudinally has the potential to improve the grounding path, when compared to an arrangement where the grounding cable is provided in a cabled construction. The bare aluminum grounding conductor is shorter in length, has more contact points with the armor and is in firmer contact with the armor and therefore has an improved grounding path when combining the two paths to ground as one, leading to an improved short circuit path.

To make sure that the aluminum bare grounding conductor withstands handling and installation, the following manufacturing practices are incorporated when making the cable. The bare grounding conductor is placed loosely in with the core during the armoring process. Some orientation around the core will occur, therefore when bending the finished cable during installation the bare grounding conductor is put under minimal strain and stretching. The bare aluminum grounding conductor is annealed after the drawing stage to meet ASTM B800 H1X or H2X temper. The minimum elongation is specified as 10% for 8000 series Aluminum. This elongation allows the aluminum to stretch when the cable endures an excessive pulling tension during the installations. The finished cable armor preferably withstands a specified pull force per requirements specified by UL 1569 or UL 4 or CSA C22.2 No 51 and the bare aluminum conductor will remain intact and meet all test specifications per ASTM. In accordance with various embodiments of the invention, the temper is maintained and kept as close to the minimum 10% set point during manufacturing, to prevent damaging the bare aluminum conductor during the armoring process.

In accordance with one embodiment of the invention, the 2 conductors of cable 10 are made of 14 AWG solid copper wire and having a PVC insulation wall of 0.015" and a nylon jacket wall of 0.004". The bare aluminum grounding conductor is made of 12 AWG solid aluminum #8030 alloy, which is annealed having an elongation of not less than 10%. The armor is formed using an aluminum strip Alloy 5154A having a 0.022" in thickness×0.375" width.

During manufacturing of cable 10, each conductor 14 and 16 is provided to a lay plate and is pulled together through an orifice to be twisted together. A SZ cabling machine pulls the conductors while twisting them as they are pulled in accordance with a predetermined lay pitch. A Polypropylene printed legend tape binder 0.004"×1" is then applied around the conductors. After the lay plate of the SZ cabling machine an aluminum grounding conductor 20 is pulled together along the conductors, such that the grounding conductor is laid longitudinally along the tape without being twisted into the conductor assembly.

The AWG size of the grounding conductor is specified in UL 1569 and the NEC grounding requirements. When incorporating an aluminum grounding conductor in place of a copper conductor, the size of the aluminum grounding conductor is sized up by approximately 1 AWG size to retain the same conductivity exhibited by a copper conductor.

An interlocked metal tape armor is then helically disposed on the entire assembly by an armoring machine at a rate of 142 turns per meter. The edges of the wrapped metal armor 22 are shaped to interlock along the length of the cable. In accordance with another embodiment of the invention, aluminum grounding conductor 20 is substituted with a copper clad aluminum grounding conductor 20 having the same electrical resistance as the substituted aluminum conductor.

Figure 2:
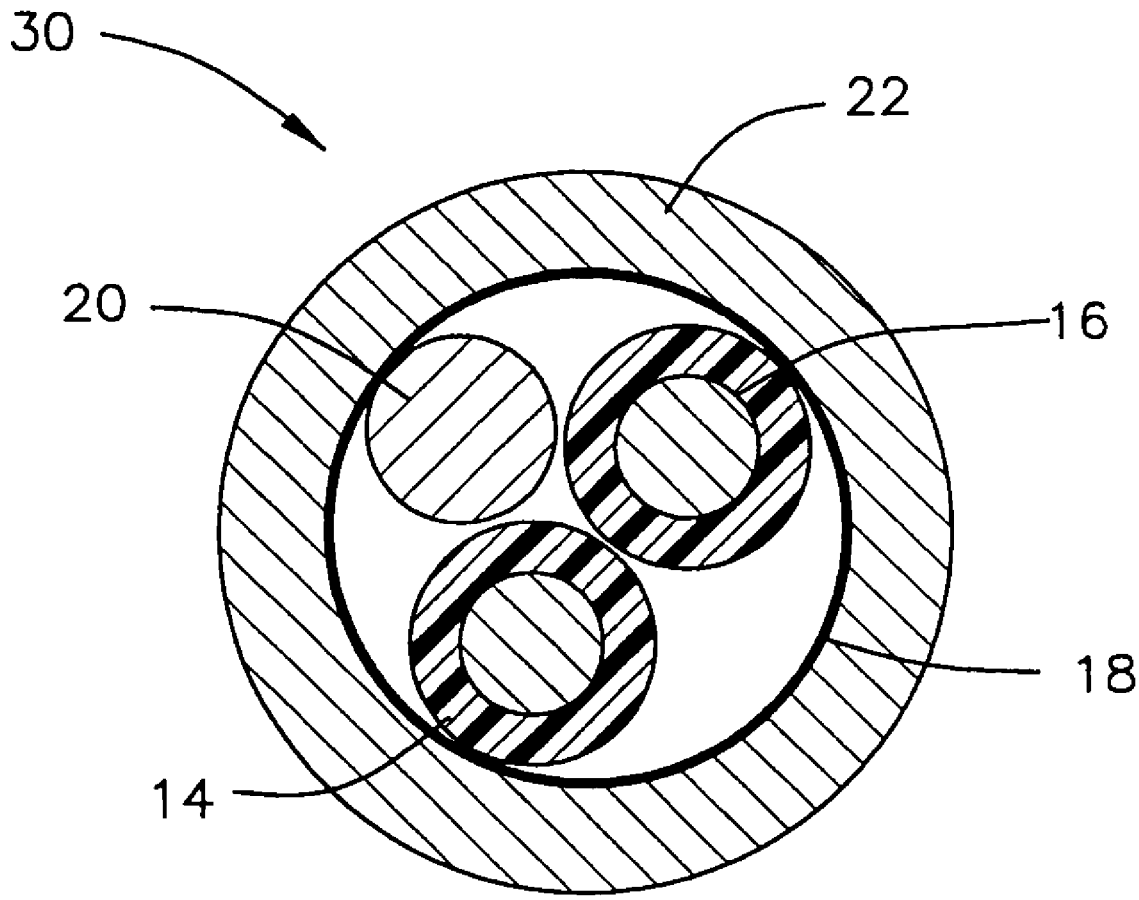
FIG. 2 illustrates a cable having a bare grounding conductor cabled under the tape binder covering and made in compliance with UL 1569 and UL 4, in accordance with another embodiment of the invention.

Referring to FIG. 2 another metal clad cable 30 is illustrated in accordance with one embodiment of the invention. Cable 30 includes twisted conductors 14 and 16 and a bare aluminum grounding conductor 20 as explained before in connection with FIG. 1. However, tape binder 18 in cable 30 is disposed around the entire assembly, including the aluminum grounding conductor. In accordance with one embodiment of the invention, the construction of cable 30 complies with standards set for by UL 4, and UL 1569.

In accordance with this embodiment of the invention, cable 30 meets the dielectric tests performed under various standards such as UL 1569 and UL 4. It is noted that the voids between the cables are preferably unfilled, although the invention is not limited in scope in that respect.

It is noted that in accordance with one embodiment of the invention, the aluminum material used for the grounding cable is annealed. For example, the #8030 series aluminum wire is drawn from ⅜" rod to the required AWG size as specified by UL 1569 or UL 4 or CSA C22.2 No. 51 and wound onto bobbins. The bobbins of aluminum wire are stacked on skids and put into an annealing oven where the temperature is brought up to a specified temperature (dependant on the type of annealing oven used) for a fixed time to ensure that the whole bobbin with conductor comes up to the set temperature and then the oven is cooled to bring back the aluminum conductor to room temperature, so it can be handled in manufacturing at the next process.

The annealing of the aluminum wire can be checked by performing an elongation lest. As mentioned earlier, this elongation is preferably, not less than 10% as specified by ASTMB800 H1X or H2X for #8000 series aluminum. To this end, the anneal process employed in accordance with various embodiments of the invention has been chosen to exhibit an elongation of not less than 10%. It is noted that annealed aluminum is chosen allowing the cable to be more flexible. It is further noted that excessive annealing is preferably avoided as the conductor can be prone to surface damage during the armoring process. Annealed aluminum also allows the cable to bend more often without hardening and breaking.

Various annealing techniques may be employed in accordance with various embodiments of the invention and as such the invention is not limited in scope in that respect. For example, there are alternative methods to anneal the aluminum such as in-line resistance annealing or other techniques. In accordance with one embodiment of the invention, the bare aluminum grounding conductor is manufactured on bobbins, likewise the conductor can also be processed on stems or other methods.

The conductors are assembled using an SZ process which is in line with the armoring line so that all work is performed in one step and one setup. The insulated conductors are passed through the SZ machine and a lay, as specified in UL 1569, is introduced right or left hand for not less than 5 complete twists (full 360 degree cycles). When the lay changes, the transition zone shall preferably not exceed 1.8 times the max lay per UL 1569. The binder is inserted as the cabled core leaves the SZ machine and self wraps to ensure full coverage. Furthermore, the bare grounding conductor is directed onto the binder by-passing the SZ machine and applied straight, without lay. The armoring machine forms the flat aluminum strip armor over the aluminum grounding conductor and SZ assembly. Some rotation of the assembly will occur as a result of the armoring process. This is desirable as it makes the finished cable looser, leading to good flexibility for the user at installation.

It is noted that although the SZ cabling method has been described and is one method to manufacture the product described herein, other methods of cabling exist and can be used and as such the invention is not limited in scope in that respect. The size of the aluminum grounding conductor is preferably not more than a 10 AWG for most MC sizes. As such the 12 AWG MC employs a 10 AWG aluminum grounding conductor and a 14 AWG MC incorporates a 12 AWG bare aluminum grounding conductor.

Figure 3:
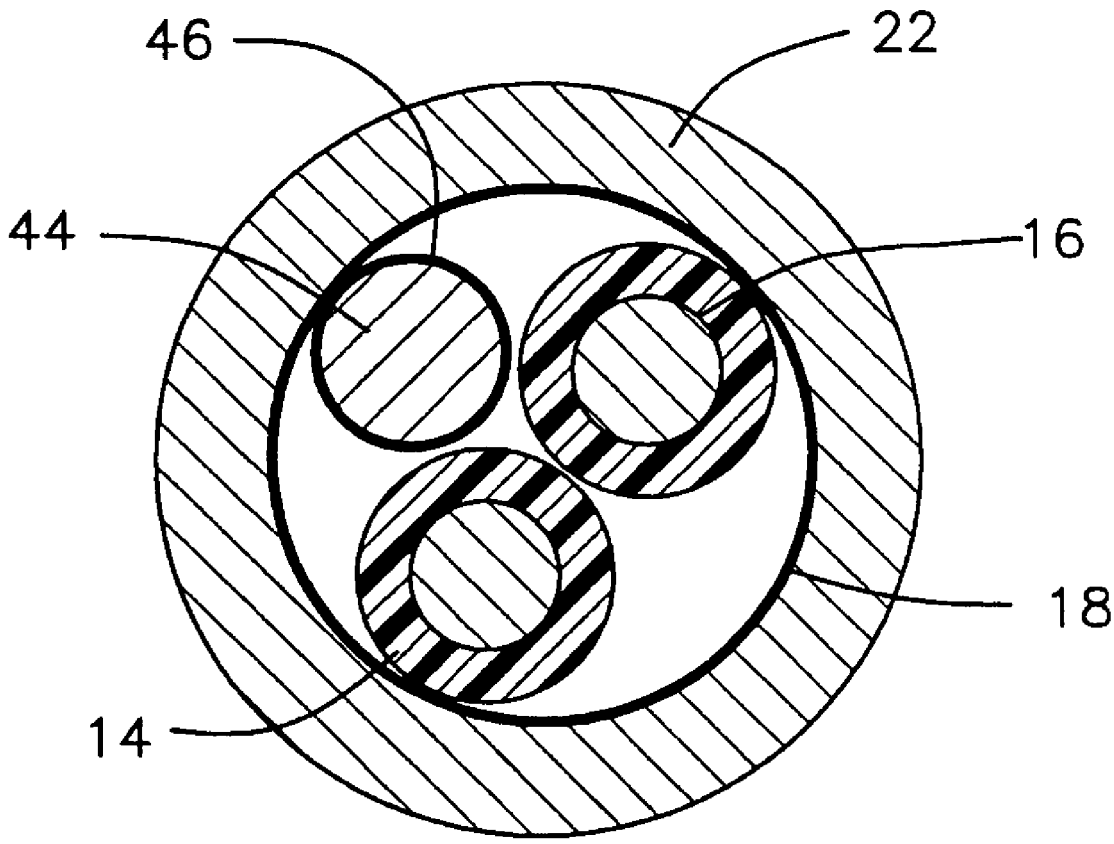
FIG. 3 illustrates a cable having a bare grounding conductor that is paper wrapped-and cabled under the tape binder covering and made to UL 1569 and UL 4, in accordance with yet another embodiment of the invention.

FIG. 3 illustrates a metal clad cable 40 in accordance with yet another embodiment of the invention. In accordance with this embodiment, bare aluminum grounding conductor 44 is paper wrapped by a paper 46. The paper is used in place of the insulation and may be considered more user friendly as the installer does not need to take the time to strip the paper to bare the conductor and make the termination thereby saving installation time. From a cable performance perspective, the paper is there to add some protection to help withstand the impact/crush testing specified by UL 1569. Although one way to meet such a crush test it is to increase the aluminum armor thickness, using paper in accordance with the present embodiment is less costly to manufacture.

To manufacture this construction, covering the grounding conductor with a paper covering requires that the grounding conductor is covered off-line. Furthermore, FIGS. 2 and 3 illustrate having the binder just under the armor. This is because the tape binder is applied during the armoring stage.

However, in accordance with another embodiment of the invention the tape binder is put in at the cabling stage, such that the tape binder covers the conductor assembly.

Figure 4:
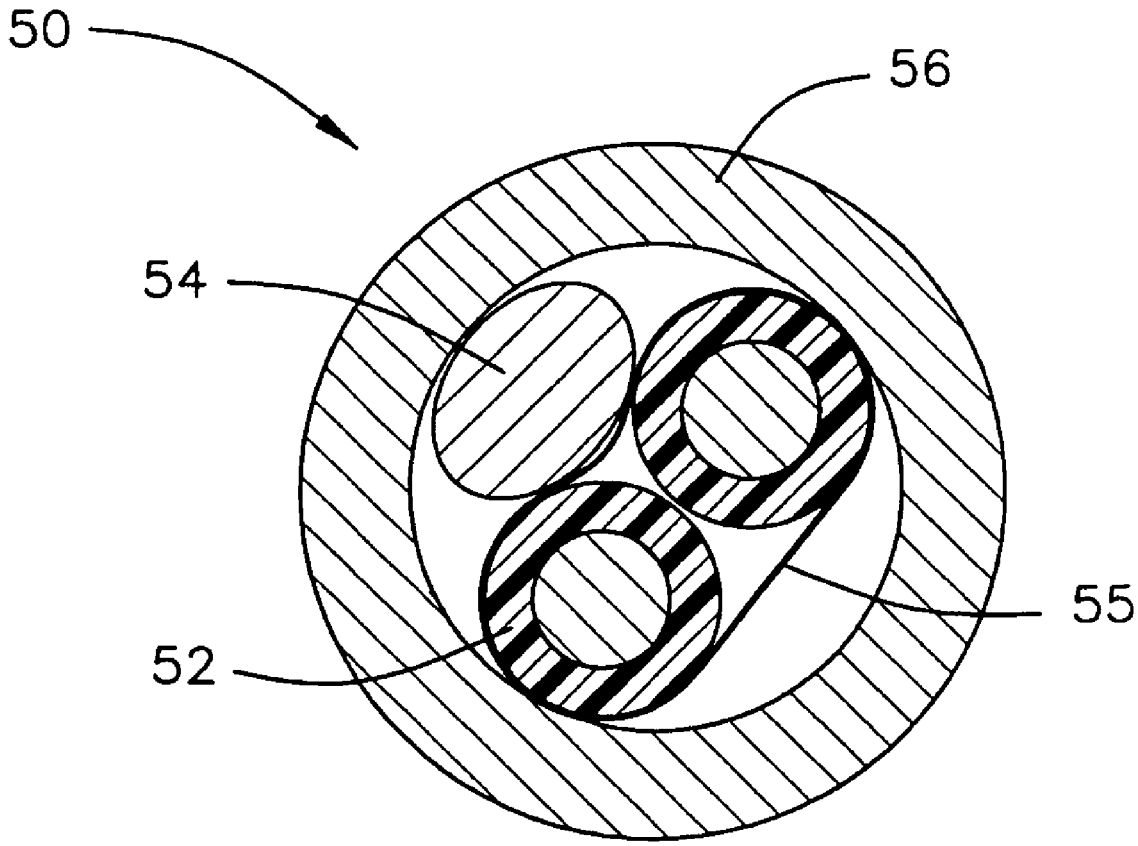
FIG. 4 illustrates a shaped bonding conductor placed longitudinally over the tape binder and in contact with the armor and made to UL 1569 and UL 4.

FIG. 4 illustrates a metal clad cable 50, in accordance with yet another embodiment of the invention. To this end, cable 50 includes a core conductor assembly 52 with insulated phase conductors that are cabled with a predetermined lay length. In this embodiment, bare aluminum grounding conductor 54 is depicted as being elliptical in shape and laid externally and longitudinally along the core conductor assembly. Furthermore, in accordance with one embodiment of the invention, the conductor core assembly is laid longitudinally along the length of the cable without any cabling. Furthermore, in accordance with yet another embodiment of the invention, the bare aluminum grounding conductor may be composed of more than one individual conductor.

Although the exemplary embodiment of FIG. 4 illustrates an elliptical shaped grounding wire, the invention is not limited in scope in that respect and grounding wire shape includes all feasible shapes, as long as the cross-sectional area of the bare grounding conductor equals the cross-sectional area of its corresponding conductor AWG size specified in UL 1569. The advantage with using a shaped bare conductor is that there is a better opportunity to minimize the voids in the cable construction, thereby reducing the overall diameter of the finished cable size. A further advantage is that a shaped grounding conductor improves the electrical contact between the bare grounding conductor and metal armor 56. Additionally the shaped bare grounding conductor can be an advantage to help pass the impact/crush tests that are specified in UL 1569. Furthermore, as mentioned before, the aluminum grounding cable is not limited to just one single elliptical bonding wire, but to several to make up the shape to fill the voids. As an example, to replace a 12 AWG aluminum grounding conductor, 0.022"×0.233" aluminum strips could be used.

The aluminum bonding strip is required to be tempered for the same reasons as that described in connection with FIG. 1, allowing the finished cable to bend and handle more easily by the user during installation. Additionally, there is less chance to mark and knick the aluminum bonding strip during armoring. The bonding strip can be purchased directly from the supplier in any shape or alternatively one can manufacture the shape by rolling it from round stock to the required shape that is most economical in line at SZ cabling-armoring operation.

It is appreciated by those skilled in the art that the grounding conductors described in accordance with various embodiments of the present invention are of sufficient size to provide conductivity sufficient for the grounding characteristics specified by various standards, such as those imposed by UL 1569 and UL 4 and CSA C22.2 No. 51.

In any event, as mentioned above, the shape of the grounding cable allows for a more compact assembly of the cable. As such, other shapes for the grounding conductor are also contemplated, and the invention is not limited in scope in that respect. For example other simple and complex geometrical shapes are contemplated within the scope of the present invention.

Figure 5:
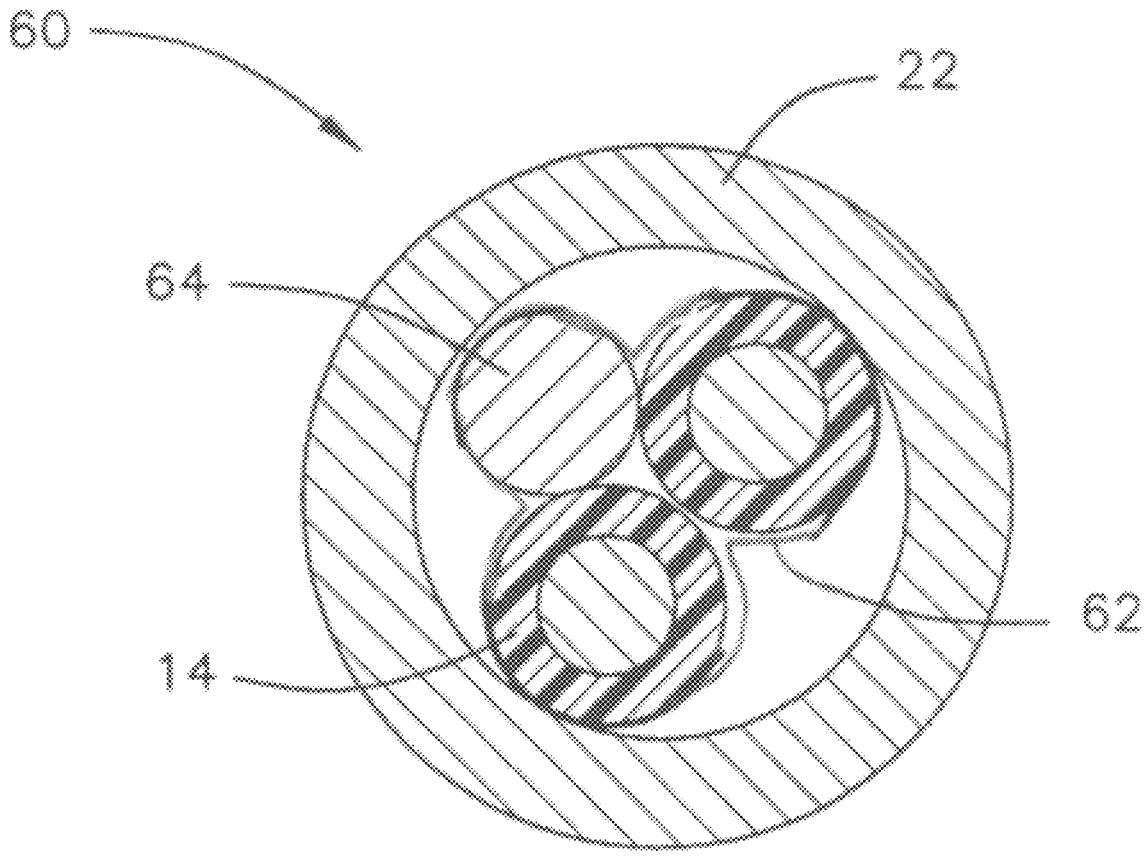
FIG. 5 illustrates an armored clad AC90 cable having a bare aluminum grounding conductor under the paper wrap and made in compliance with CSA C22.2 No. 51, in accordance with one embodiment of the invention.

In accordance with yet another embodiment of the present invention, FIG. 5 illustrates cable 60 having a bare copper grounding conductor 64 cabled with the core conductors. However, in accordance with one embodiment of the present invention, a non-wicking Clupak paper tape binder 62 covers the entire conductor and grounding conductor assembly in such a manner wherein the paper substantially takes the shape of the periphery of the cabled conductors and grounding conductor.

Cable 60 is an AC90 cable construction, which in accordance with one embodiment of the invention is made in compliance with CSA C22.2 No. 51 standard. This standard allows a bare copper conductor to be used for grounding conductor 64. The assembly is preferably wrapped to prevent the copper conductor from touching the aluminum armor to avoid aluminum-copper metal corrosion. Additionally, the paper wrap provides resistance against the armor inner surface and to meet the pull out performance specified in CSA C22.2 No. 5. Other tape binder materials can be used such as polypropylene, but that may make it harder to meet and maintain this test requirement, because of the lower coefficient of friction. Circuit size (14 to 10 AWG) MC cables do not have the pull-out performance criteria, as specified in UL 1569, as does CSA C22.2 No. 51, therefore allowing polyester or polypropylene tape binders to be used. Additionally, the user typically prefers paper, because it can be torn away more easily and removed during installation. To remove polyester or polypropylene binders, a set of cutters would have to be used. The insulation system on the conductors is typically XLPE insulation although the invention is not limited in scope in that respect and other materials are also contemplated.

The, grounding conductor terminations during installation in accordance with various embodiments of the present invention are carried out differently depending on the construction, which are described hereinafter. For example, for the cable described in FIG. 1, the method of termination requires only that the grounding conductor is cut flush with the armor and then placed into a connector and fastened to the electrical box.

The cable described in FIG. 2 requires the installer to bend the grounding conductor back and then place it in the connector and fasten to the box. In accordance with this embodiment, a dielectric fault is more readily detected compared to an arrangement described in FIG. 1.

Likewise, the cable described in FIG. 3 is terminated similar to the cable described in FIG. 2. During the termination the paper wrap is removed as an extra step. In this embodiment, a dielectric fault in the assembly is not as readily detected as when the grounding conductor is uncovered.

Figure 6:
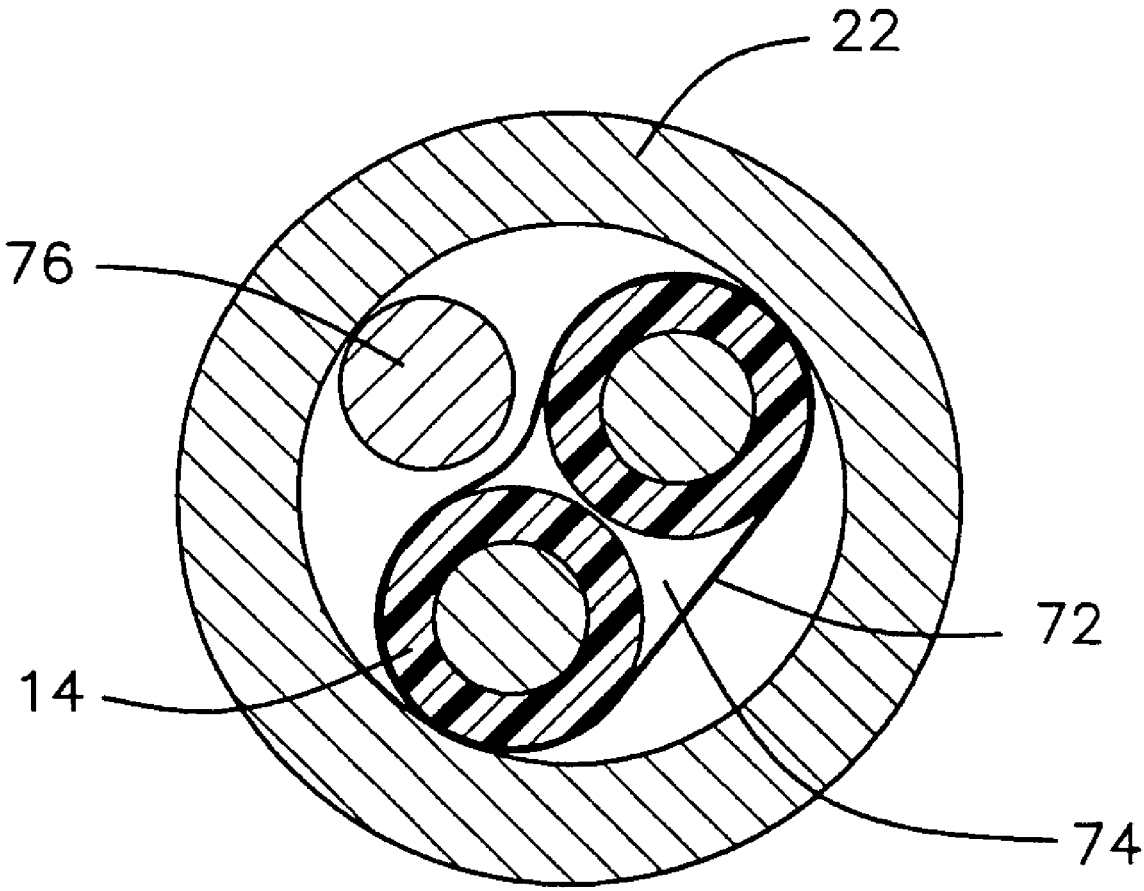
FIG. 6 illustrates another armored clad AC90 cable having bare grounding conductor placed longitudinally over the paper wrap and in contact with the armor and in compliance with CSA C22.2 No. 51, in accordance with one embodiment of the invention.

FIG. 6 illustrates a metal clad cable 70 in accordance with yet another embodiment of the invention. In this embodiment, the bare aluminum grounding conductor 76 is cabled and placed in the interstice of the core conductor assembly and externally to a non-wicking Clupak paper tape binder 72 that covers conductor core assembly 74. Paper tape binder 72 covers the conductors in such a way that it takes substantially the shape of the periphery of the cabled conductors. In accordance with another embodiment of the invention, bare aluminum grounding cable 76 is laid longitudinally without being cabled or twisted with the conductor cables.

To manufacture the cable as described by FIG. 6 requires one to assemble it off-line and add a step to the manufacturing process, which adds cost. One advantage for this type of construction is that the bare aluminum grounding conductor is held by the other cabled conductors, and holds the paper binder in place until armoring.

Figure 7:
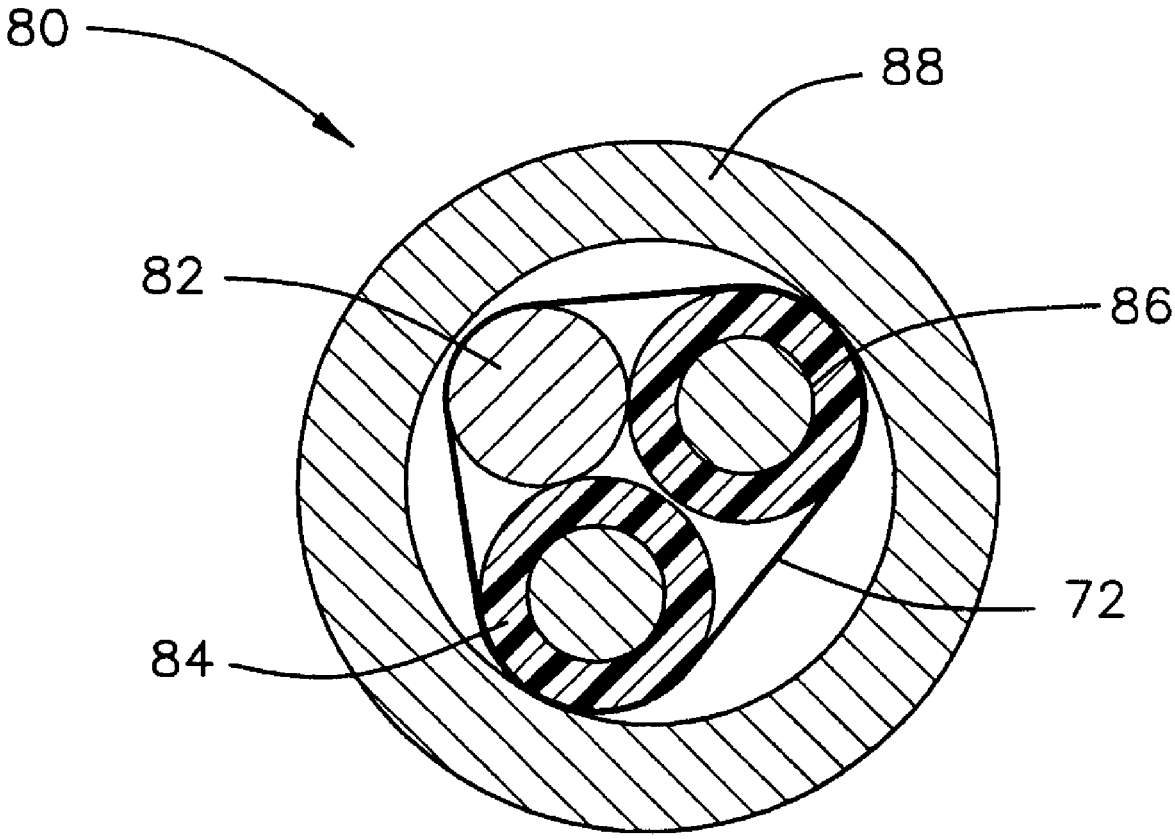
FIG. 7 illustrates yet another armored clad AC90 cable having all conductors laid longitudinally in compliance with CSA C22.2 No. 51, in accordance with one embodiment of the invention.

In accordance with another embodiment of the invention, the conductors depicted in FIG. 7 are laid longitudinally along the length of cable 80 without being twisted or cabled together. Furthermore grounding conductor 82 is laid longitudinally along with conductors 84 and 86 and the entire assembly is covered by a non-wicking Clupak paper tape binder in such a manner that the cover takes the shape of the periphery of the conductors.

The advantage of the cable assembly described in FIG. 7 is that the cabling step has been eliminated and no longer is required. With no cabling there is no excess factor from the twist leading to a further at least 0.5% material cost reduction. During manufacturing, the conductors are supplied freely into the armoring machine, such that they remain loose in the finished cable, avoiding a springy finished product.

Figure 8:
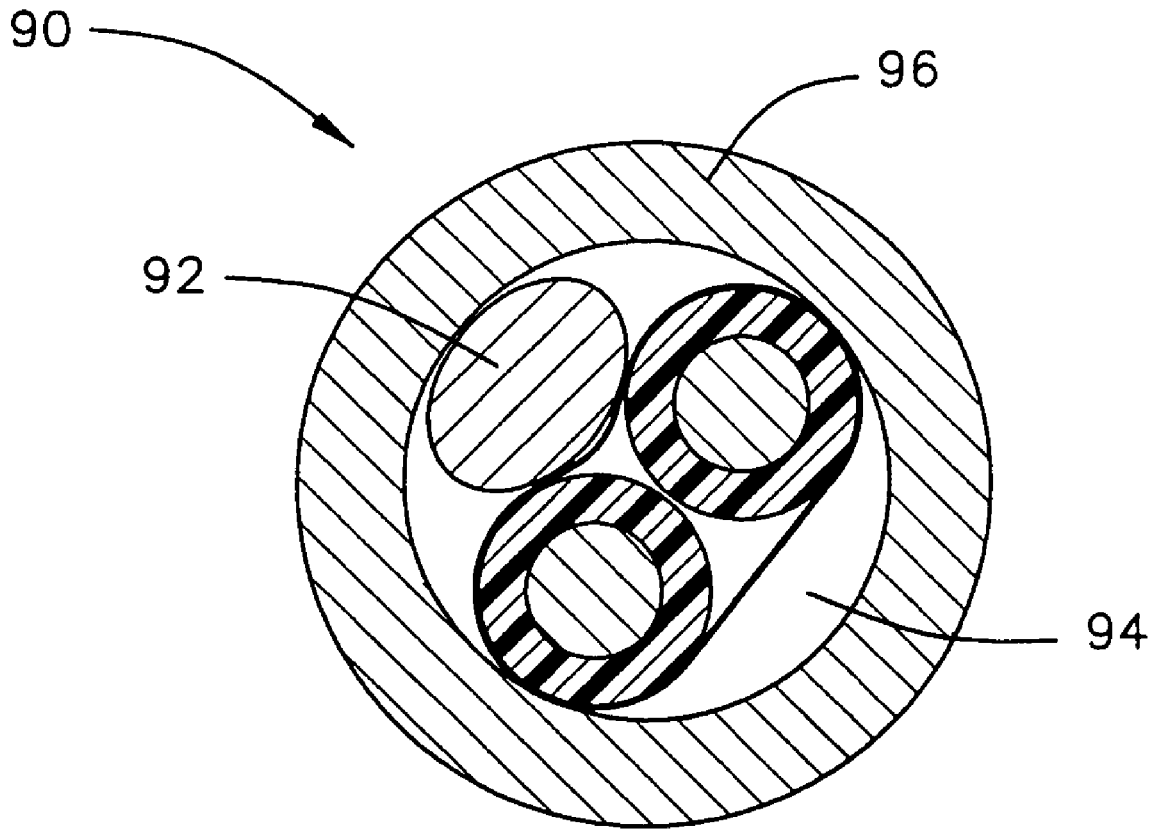
FIG. 8 illustrates another armored clad AC90 product with a shaped bonding conductor, placed longitudinally over the paper wrap in compliance with CSA C22.2 No. 51, in accordance with another embodiment of the invention.

In accordance with another embodiment of the invention, the cable depicted in FIG. 8 is constructed in a manner similar to the cable in FIG. 4, except that the cable is manufactured in accordance with C22.2 No. 51.

The reduction in cross section of the bare aluminum grounding conductor is also contemplated within the scope of the present disclosure and accompanying claims. To this end in accordance with one embodiment of the invention, the ground path of the metal armor is combined with the bare aluminum grounding conductors each depicted in FIGS. 1, 4, 6, 8 and considered as one, a reduction in cross section of the bare aluminum grounding conductor is contemplated to reduce the cost of the cable.

Furthermore in accordance with another embodiment of the invention, the covering in each of the FIGS. 1-8 is eliminated within the scope of the present disclosure and accompanying claims.

Figure 9A:
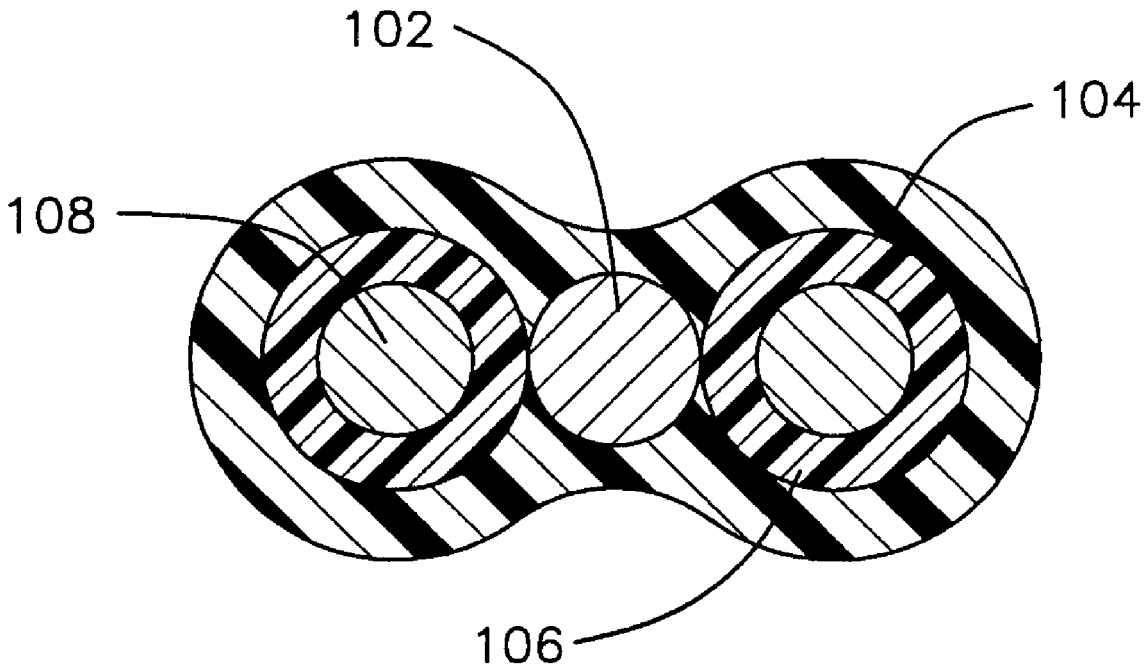
FIGS. 9(*a*) through 9(*c*) illustrate various non-metallic cables with a bare aluminum grounding conductor in accordance with another embodiment of the invention.
Figure 9B:
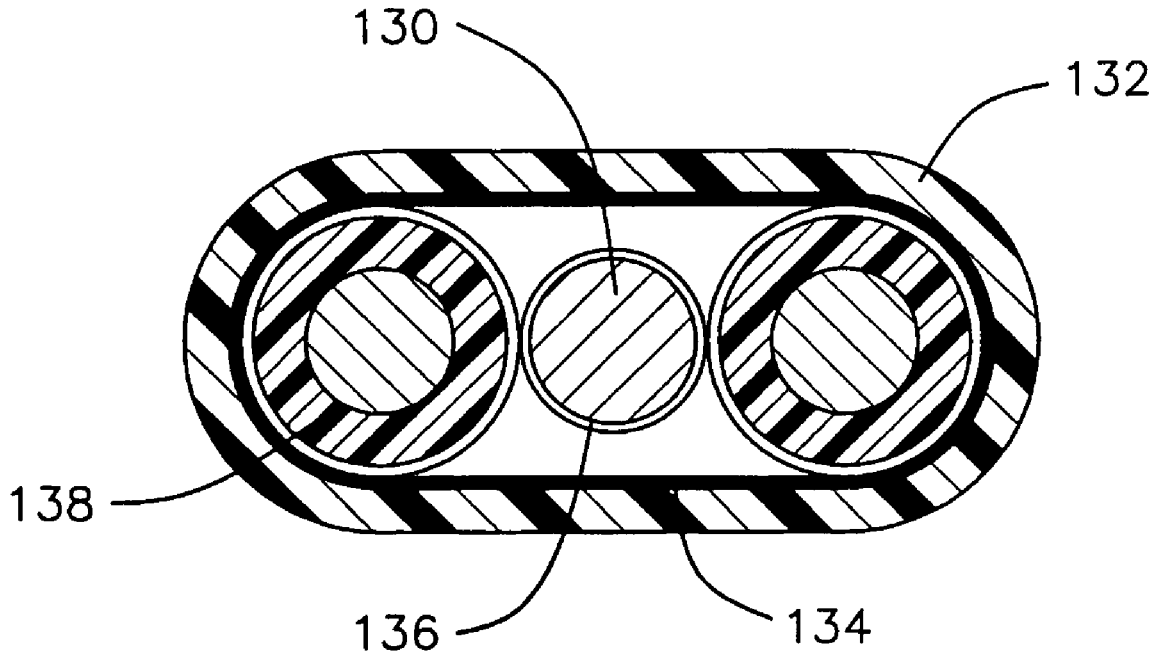
Figure 9C:
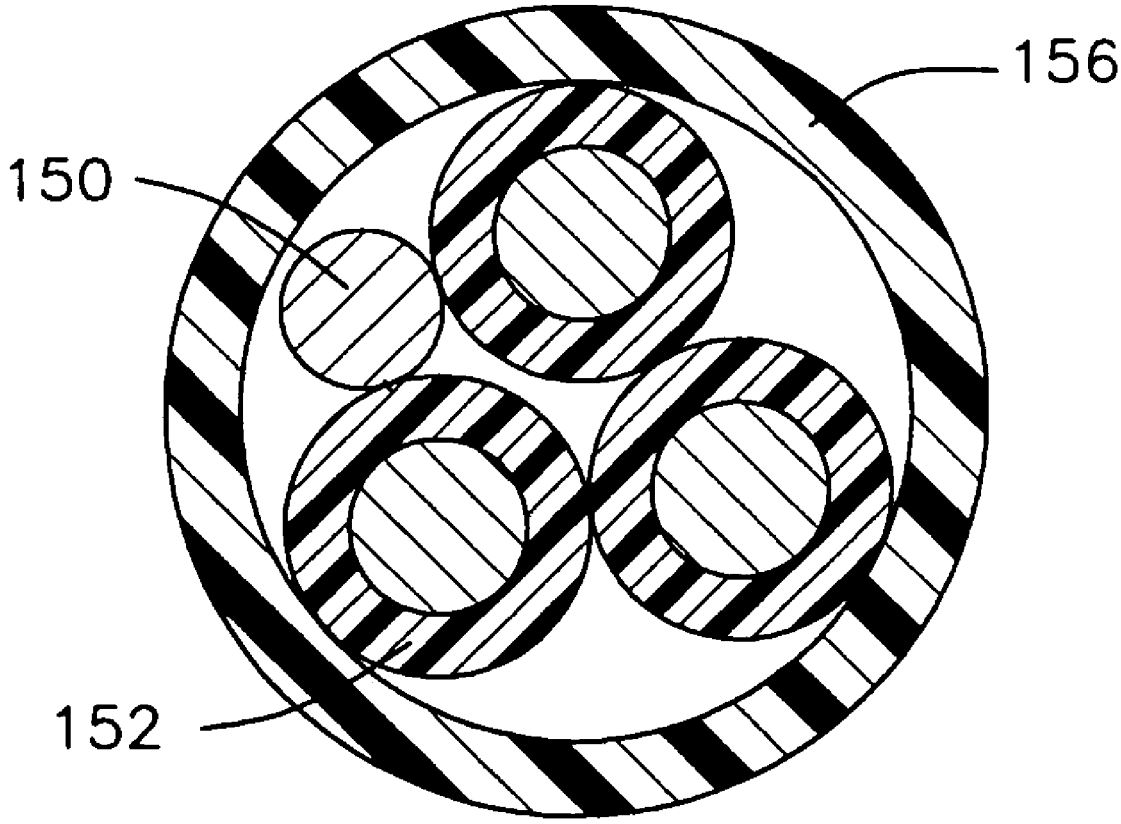

In accordance with another embodiment of the invention, for a non-metallic cable, the bare copper is being replaced with a bare aluminum conductor as that depicted in FIGS. 9(*a*) through 9(*c*). Mixing of conductor types in a non-metallic cable construction is new and currently not allowed by the applicable standards. The advantage for this type of construction is that the overall cable material costs are significantly reduced. Testing was conducted on Series 8000 aluminum alloy but the scope of the present embodiments and appending claims is not limited to this alloy or combination of metals. To this end, FIG. 9(*a*) illustrates one embodiment wherein insulated conductors 108 and 106 are laid longitudinally along the length of the cable, with a bare aluminum grounding conductor 102 laid in between them. A sheath 104 forming an "8" figure around the cable is disposed along the length of the cable. Sheath 104 is made of any acceptable polymeric material, for example, such as Polyvinylchloride.

As illustrated in FIG. 9(*b*) a bare aluminum grounding conductor 130 is covered by a non-wicking paper such as Clupak paper 136. Furthermore, insulated conductors adjacent to the grounding cable are also covered by a non-wicking paper 134, such as a Clupak paper.

Furthermore, for the 3 conductor arrangement of FIG. 9(*c*) referred to as NMD90 cable made to CSA C22.2 No. 48, in accordance with another embodiment of the invention, the insulated conductors and bare aluminum grounding conductor 150 are laid longitudinal in the manner, which is described in connection with FIG. 7.

In accordance with various embodiments of the invention the following tables provide the test results for each of the cables described above. For example, table 1 provides the test results for the cable described in FIG. 1.

| 3/c 14(19w) AWG MC Al Grounding Conductor outside Polypropylene in contact with Armor. |
|---|
| Sample 3/c 14(19) MC passed the following tests as specified in UL 1569.<br>Dielectric test:. Pass 3000 V AC for 1 second<br>Pullout test. Pass 150 LB dead load test for 5 minutes<br>ACM ground wire elongation 20% vs. 10% Minimum per CSA C22.2 No. 48. Pass<br>ACM bending test per CSA C22.2 No. 51 Section 5.1.3. 8 cycles vs. Minimum 2 Pass<br>MC crush test results 7797 N vs. 4500 N Minimum. Pass<br>Impact test results 2 ground wire faults out of 10 vs. maximum requirement of 2 of 10 faults<br>Resistance of armor test. 8.3 ohm/km at 25° C. vs. 8.91 max. Pass.<br>Current test using steel enclosure UL 1569. Pass<br>Dimensions: |
| ACM grounding conductor CMA 99.5% vs. 95% Minimum<br>Red, White, Black Copper conductors Circular Mil Area (CMA) 99.8% vs. 96.8% Minimum<br>PVC insulation Red, White, Black, wall .018" avg., .015" min 1 pt.<br>Nylon jacket Red, White, Black wall .0047 avg., .004 min 1 pt.<br>Cabled Lay 4.75"<br>Armor 142 Turns Per Meter pitch with an overall diameter .483" |

Table 2 illustrates the results in connection with the cable illustrated in FIG. 2.

TABLE 2

| FIG. #2 test results.<br>NT/3/c 14(19w) AWG MC with Al Grounding Conductor inside Polypropylene Core Wrap. |
|---|
| Sample 3/c 14(19) MC has passed the following tests as specified in UL 1569.<br>Dielectric test: Pass. 3000 V AC for 1 second<br>Pullout test. Pass. 150 LB dead load test for 5 minutes<br>ACM ground wire elongation 20% vs. 10% Minimum per CSA C22.2 No. 48. Pass<br>ACM Flexibility test per CSA C22.2 No. 51 Section 5.1.3. 8 cycles vs. Minimum 2 Pass..<br>MC crush test results 6060 N vs. 4500 N Minimum. Pass.<br>The sample did not pass the impact test. Another sample has to be made with thicker armor strip.<br>Impact test results: 5 ground wire faults out of 10 vs. maximum requirement of 2 of 10 faults<br>Dimensions: |
| ACM grounding conductor CMA 97.6% vs. 95% Minimum<br>Red, White, Black Copper conductors CMA 99.8% vs. 96.8% Minimum<br>PVC insulation Red, White, Black wall .017" avg., .0154" min 1 pt.<br>Nylon jacket Red, White, Black wall .0045 avg., .004 min 1 pt.<br>Cabled Lay 4.75"<br>Armor 142 Turns Per Meter pitch with an overall diameter .480" |

Table 3 illustrates the test results for the cable illustrated in FIG. 3.

TABLE 3

| FIG. #3 test results<br>3/c 14(19w) AWG MC with Paper Wrapped Al Grounding Conductor inside Polypropylene Core Wrap. |
|---|
| Sample 3/c 14(19) MC has passed the following tests as specified in UL 1569.<br>Dielectric test:. Pass 3000 V AC for 1 second<br>Pullout test. Pass 150 LB dead load test for 5 minutes<br>ACM ground wire elongation 20% vs. Minimum 10% Per CSA C22.2 No. 48. Pass. |

TABLE 3-continued

| FIG. #3 test results<br>3/c 14(19w) AWG MC with Paper Wrapped Al Grounding Conductor inside Polypropylene Core Wrap. |
|---|
| Flexibility of ACM Conductor per CSA C22.2 No 48 8 cycles vs. Minimum 2. Pass.<br>MC crush test results 6780 N vs. 4500 N Minimum. Pass.<br>The sample did not pass the impact test requiring another sample will have to be made with thicker armor strip.<br>Impact test results: 4 ground wire faults out of 10 vs. maximum requirement of 2 of 10 faults<br>Dimenstions |
| Al grounding conductor CMA 96.8% vs. 95% Minimum<br>Red, White, Black Copper conductors CMA 99.6% vs. 96.8% Minimum<br>PVC insulation Red, White, Black wall .018" avg., .0157" min 1 pt.<br>Nylon jacket Red, White, Black wall .0048 avg., .0042 min 1 pt.<br>Cabled Lay 4.75"<br>Armor 142 Turns Per Meter pitch with an overall diameter .490" |

Table 5 illustrates the test results for the cable illustrated and described in reference with FIG. 5.

TABLE 5

| FIG. #5 test results. |
|---|
| 2/c 14(s) AWG AC90 with #12 Al Grounding Conductor in core under the paper wrap. |
| The sample has passed the following tests as per CSA C22.2 No. 51<br>Armor Tension test. Pass. Armor does not open under 136 kg load for 1 minute<br>Mechanical Damage Impact. Pass (0 of 10 faults) No mechanical damage as indicated by short circuits or ground faults are permitted.<br>Mechanical Damage Crush. 4695 N vs. 4500 N Minimum. Pass<br>Flexibility of Armor. Pass. Armor does not open when cable is bent.<br>Tightness of Armor Pass 'Conductor assembly withdrawn less than 13 mm under load of 100 N for 1 minute.'<br>Current overload Pass. No breakdown after 1 minute at 1500 VAC.<br>Resistance of armor test. 7.71 ohm/km at 25° C. vs. 8.91 max. Pass.<br>Current test using steel enclosure UL 1569. Pass<br>12 AWG Bare Al Grounding Conductor Test Results. |
| Conductor.Tensile Strength 118 Mpa vs. 103 to 138 requirement.<br>Elongation 22% vs. Minimum 10%<br>Flexability 8 cycles vs. Minimum 2<br>Dimensions: |
| Al grounding conductor conductor CMA 96.8% vs. 95% Minimum<br>Red, White, Black Copper conductors CMA 99.6% vs. 96.8% Minimum<br>PVC insulation Red, White, Black wall .018" avg., .0157" min 1 pt.<br>Nylon jacket Red, White, Black wall .0048 avg., .0042 min 1 pt.<br>Cabled Lay 4.75"<br>Armor 142 Turns Per Meter pitch with an overall diameter .490" |

Table 6 illustrates the test results in connection with the cable illustrated and described in FIG. 6.

TABLE 6

| FIG. #6 test results. |
|---|
| 2/c 12(s) AWG AC90 with #12 Al Grounding Conductor outside the paper wrap. |
| The sample has passed the following tests as per CSA C22.2 No. 51<br>Armor Tension test. Pass. Armor does not open under 136 kg load for 1 minute<br>Mechanical Damage Impact. Pass (0 of 10 faults) No mechanical damage as indicated by short circuits or ground faults are permitted.<br>Mechanical Damage Crush. 4413 N vs. 4500 N Minimum. Marginal failure.<br>Flexibility of Armor. Pass. No exposure of conductor assembly.<br>Bushing Insertion Pass 'The bushing inserts readily between core and armor and then remains in position.'<br>Tightness of Armor Pass 'Conductor assembly withdrawn 13 mm under load of 100 N for 1 minute.'<br>Interior Surface Pass 'Free of burrs and sharp edges'.<br>Low Temperature Flexibility at −40° C. Pass 'No cracks'<br>Low Temperature Impact at −40° C. Pass 'No cracks'<br>Mechanical Damage Impact at Room Temperature. Pass 'No short circuits or ground faults'<br>Current overload Pass. No breakdown after 1 minute at 1500 VAC.<br>Elongation of Armor. Pass. Elongation is nil. vs. 75 mm maximum<br>12 AWG Bare Al Grounding Conductor Test Results. |
| Conductor.Tensile Strength 112 Mpa vs. 100 to 140 requirement.<br>Elongation 20% vs. Minimum 10%<br>Flexability 8 cycles vs. Minimum 2<br>Dimensions QA audit was performed and all materials were checked and pass. |

Table 7 illustrates the test results for the cable described in connection with Table 7.

TABLE 7

| FIG. #7 test results.<br>2/c 14(s) AWG AC90 all conductors laid parallel. |
|---|
| The sample has passed the following tests as per CSA C22.2 No. 51<br>Armor Tension test. Pass. Armor does not open under 136 kg load for 1 minute<br>Mechanical Damage Impact. Pass (0 of 10 faults) No mechanical damage as indicated by short circuits or ground faults are permitted.<br>Mechanical Damage Crush. 4733 N vs. 4500 N Minimum. Pass<br>Flexibility or Armor. Pass. Armor does not open when cable is bent.<br>Bushing Insertion Pass 'The bushing inserts readily between core and armor and then remains in position.'<br>Tightness of Armor Pass 'Conductor assembly withdrawn 13 mm under load or 100 N for 1 minute.'<br>Interior Surface Pass 'Free or burrs and sharp edges'.<br>Low Temperature Flexibility at −40° C. Pass 'No cracks'<br>Low Temperature Impact at −40° C. Pass 'No cracks'<br>Mechanical Damage Impact at Room Temperature. Pass 'No short circuits or ground faults'<br>Current overload Pass. No breakdown after 1 minute at 1500 VAC.<br>Elongation of Armor. Pass. Elongation is nil. vs. 75 mm maximum |

Table 9 illustrates the test results for the cable described in FIG. 9.

TABLE 9

| FIG. #9 Test Results. |
|---|
| 2/c 14(s) AWG, NMD90 with 14 AWG Aluminum Ground Wire |
| The following tests were performed and measured against CSA C22.2 No. 48:<br>Cold Bend Test at −30° C. Pass 'No cracks'<br>Cold Impact Test at −25° C. Pass '2 of 10 specimens maximum may crack'<br>Flame Test (FT1) Pass Shall not convey nor burn flag.<br>Heat Shock at 131° C. Pass 'No cracks'<br>Current Overload Pass. "Cable has to withstand 40 amps for 15 minutes, then cool for at least 2 hours and subject to 1500 V rms for a period of 1 minute.<br>Cutting, 740 N vs. 450 minimum. Pass<br>Crushing 3163 N vs. 900 minimum. Pass<br>Room Temp Impact Pass 'no shorts'<br>12 AWG Al Ground wire test results. |
| Tensile Strength, 118 Mpa vs. 103 to 138 requirement Pass<br>Elongation, 22% vs 10% minimum Pass<br>Flexability of ACM Conductor 8 cycles vs. 2 cycles minimum Pass |

We claim:

1. An electrical power cable comprising:

a conductor core having at least two insulated phase conductors twisted together;

a binder tape configured to cover said conductor core;

a bare aluminum grounding conductor laid longitudinally outside said binder tape, along the length of said conductor core; and an interlocking metal armor disposed around said grounding conductor and said conductor core defining a metal armor for said electrical power cable, wherein said bare aluminum grounding conductor is in contact with an inside of said interlocking metal armor.

2. An electrical power cable in accordance with claim 1, wherein said binder tape is made of a material from a list of polypropylene or polyester materials.

3. An electrical power cable in accordance with claim 2, wherein said bare aluminum grounding conductor is placed loosely within said metal armor to substantially reduce strain when bending said electrical power cable.

4. An electrical power cable in accordance with claim 3, wherein said aluminum grounding conductor is annealed.

5. An electrical power cable in accordance with claim 4, wherein said electrical power cable further comprises a second aluminum grounding conductor.

6. An electrical power cable in accordance with claim 4, wherein said annealed aluminum grounding conductor exhibits an elongation of at least 10%.

7. An electrical power cable in accordance with claim 6, wherein said aluminum grounding conductor is made of 12 AWG solid series 8000 aluminum alloy.

8. An electrical power cable in accordance with claim 6, wherein said cable complies with standard requirements set forth in UL 1569.

9. An electrical power cable in accordance with claim 8 wherein said bare aluminum grounding conductor is cladded with copper.

10. An electrical power cable in accordance with claim 4 wherein said bare aluminum grounding conductor has a non-circular cross section.

11. An electrical power cable in accordance with claim 10 wherein said bare aluminum grounding conductor has an elliptical, rectangular or other geometrically shaped cross section.

12. An electrical power cable in accordance with claim 11 wherein said bare aluminum grounding conductor is composed of more than one individual conductor.

13. An electrical power cable comprising:

a conductor core having at least two insulated phase conductor cables twisted together;

a bare aluminum grounding conductor cabled with said at least two insulated phase conductors;

a binder tape surrounding said conductor core and said bare grounding conductor, wherein said binder tape substantially takes the shape of the periphery of the cabled conductor core and grounding conductor; and an interlocking metal armor disposed around said binder tape defining a metal armor for said electrical power cable.

14. An electrical power cable in accordance with claim 13, wherein said binder tape is made of a material from a list of polypropylene or polyester materials.

15. An electrical power cable in accordance with claim 14, wherein said bare aluminum grounding conductor is placed loosely in with said core within said metal armor to substantially reduce strain when bending said electrical power cable.

16. An electrical power cable in accordance with claim 15, wherein said aluminum grounding conductor is annealed.

17. An electrical power cable in accordance with claim 16, wherein said annealed aluminum grounding conductor exhibits an elongation of at least 10%.

18. An electrical power cable in accordance with claim 17, wherein said aluminum grounding conductor is made of 12 AWG solid series 8000 aluminum alloy.

19. An electrical power cable in accordance with claim 18, wherein said cable complies with standard requirements set forth in UL 1569.

20. An electrical power cable in accordance with claim 14 wherein said bare aluminum grounding conductor is cladded with copper.

21. An electrical power cable in accordance with claim 14, wherein said bare aluminum grounding conductor is wrapped in a paper.

22. An electrical power cable in accordance with claim 21, wherein said paper surrounding said bare aluminum grounding conductor is made of a moisture-resistant, flame retardant paper.

23. An electrical power cable in accordance with claim 13, wherein said power cable further comprises a second bare aluminum grounding conductor.

24. An armored electrical power cable comprising:

a conductor assembly having at least a first and a second insulated conductor laid longitudinally along the length of said cable; and a bare aluminum grounding conductor laid longitudinally along the length of said cable and adjacent to each of said first and second insulated conductors wherein said first and second insulated conductors and said bare grounding conductor are laid parallel to each other.

25. An electrical power cable in accordance with claim 24, wherein said bare grounding aluminum conductor is disposed centrally between said first and second insulated conductors.

26. An electrical power cable in accordance with claim 25, wherein said bare aluminum grounding conductor is covered by non-wicking paper separating tape, said bare aluminum grounding conductor being separated from said first and second insulated copper conductors.

27. An electrical power cable in accordance with claim 26, wherein said first and second insulated copper conductors are covered by a non-wicking paper tape binder.

28. An electrical power cable in accordance with claim 24, wherein said conductor assembly and said bare aluminum grounding conductor are covered by a polyvinylchloride jacket.

29. An electrical power cable in accordance with claim 28, wherein said jacket takes substantially the shape of the periphery of said conductor assembly and said bare aluminum grounding conductor.

* * * * *